United States Patent [19]

Gröttrup

[11] 4,230,411

[45] Oct. 28, 1980

[54] MATRIX PRINTER

[76] Inventor: Helmut Gröttrup, Wertherstrasse 14, D-8000 Munich 40, Fed. Rep. of Germany

[21] Appl. No.: 911,705

[22] Filed: Jun. 1, 1978

[30] Foreign Application Priority Data

Jun. 4, 1977 [DE] Fed. Rep. of Germany ..... 2725352

[51] Int. Cl.[3] ..... B41J 3/12

[52] U.S. Cl. ..... 400/121; 101/93.04; 400/124

[58] Field of Search ..... 400/121, 124, 125; 101/93.04, 93.05

[56] References Cited

U.S. PATENT DOCUMENTS

| | | | |
|---|---|---|---|
| 3,820,643 | 6/1974 | Priebs et al. | 400/124 |
| 3,934,695 | 1/1976 | Kovalick | 400/124 X |
| 3,963,108 | 6/1976 | Steinhausser | 400/124 |
| 4,027,761 | 6/1977 | Quaif | 400/124 |
| 4,044,878 | 8/1977 | Kunath | 400/124 |
| 4,101,017 | 7/1978 | Englund et al. | 400/124 |

*Primary Examiner*—Paul T. Sewell
*Attorney, Agent, or Firm*—Balogh, Osann, Kramer, Dvorak, Genova & Traub

[57] ABSTRACT

A matrix printer in which a plurality of printing punches in the form of sheet strips are arranged parallel to each other and are driveable in different combinations, according to the characteristics to be printed, by means of drive systems arranged in series and being associated each with a printing punch. Each drive system contains an armature, mechanically coupled to a printing punch, a magnetic circuit providing for an air gap, and a control coil. Also associated with each printing punch is a reset spring, for pulling the armature away from the air gap range into the inoperative position. The reset spring is loop-shaped and integrally formed with the associated printing punch. The magnetic circuit is provided with an air gap which is smaller than the stroke of the printing punch, so that even after closure of the air gap, the armature flies on substantially freely due to its inertia, until the printing punch strikes.

18 Claims, 7 Drawing Figures

1
2
3
5
6
7
8
9
10
11

MATRIX PRINTER

The present invention relates to a matrix printer in which a plurality of identical printing punches with punctiform print is provided which are drivable in different combinations according to the characters to be printed by means of separate electromagnetic drive systems, each drive system containing a coil and a magnetic circuit as well as a reset spring, and a moveable armature which is mechanically coupled to the printing punch associated therewith leaves in the inoperative position an effective air-gap in the magnetic circuit.

Known means of this type employ electromagnetic accelerating paths for the armatures of the drive systems in which the drive force, defined by the buildup of the magnetic circuit and the time variation of the coil current, rises up to the end of the stroke of the printing element. This results in high energy comsumption and requires different constructional configurations for different strokes of the printing elements to be achieved.

In addition, for each drive system a great number of mechanical parts is required, giving high expenditure for repairs. Moreover, this large number of parts makes these arrangements trouble-prone.

The object of the invention is to improve the known matrix printers so that they have a simpler construction, are more reliable and use less energy.

This object is achieved in a matrix printer or mosaic printing head of the type mentioned at the beginning in that the width of the effective air-gap and thus the armature movement up to closure of the air-gap is less than the stroke of the printing punch, and that the armature after closure of the air-gap due to its inertia flies on substantially freely until the printing punch strikes.

Preferably, all the printing elements traverse all the armatures of the drive systems and are guided therein by means of armature holders; the guide means for the armature holders have an inner width which is greater than the outer dimension, relevant for the assembly, for the armatures, printing elements, or armature holders. It is possible to replace all the printing punches.

The resulting compact construction is still further improved in that the magnetic fluxes of adjacent drive systems flow through common stator members.

According to a first embodiment of the invention the individual coils are energised on the basis of a current control such that the current remains constant after the rise due to the inductance of the coil. Alternatively, the current can be so controlled that after the rise due to the inductance of the coil the magnetic inductance of the magnetic circuit remains constant, taking account of the change of the air-gap caused by the armature movement.

If the current is controlled jointly, a common function generator is preferably used for all coils.

Within the scope of the invention, either all the printing punches selected for a printing operation can be driven simultaneously, which is preferred at high printing speeds but requires high instantaneous powers, or alternatively the selected printing punches are driven successively, which is possible only with low printing speeds but results in a substantial reduction of the energization.

The invention will be explained hereinafter with reference to a preferred example of embodiment with the aid of the seven Figures of the drawings, wherein.

Figure 1:
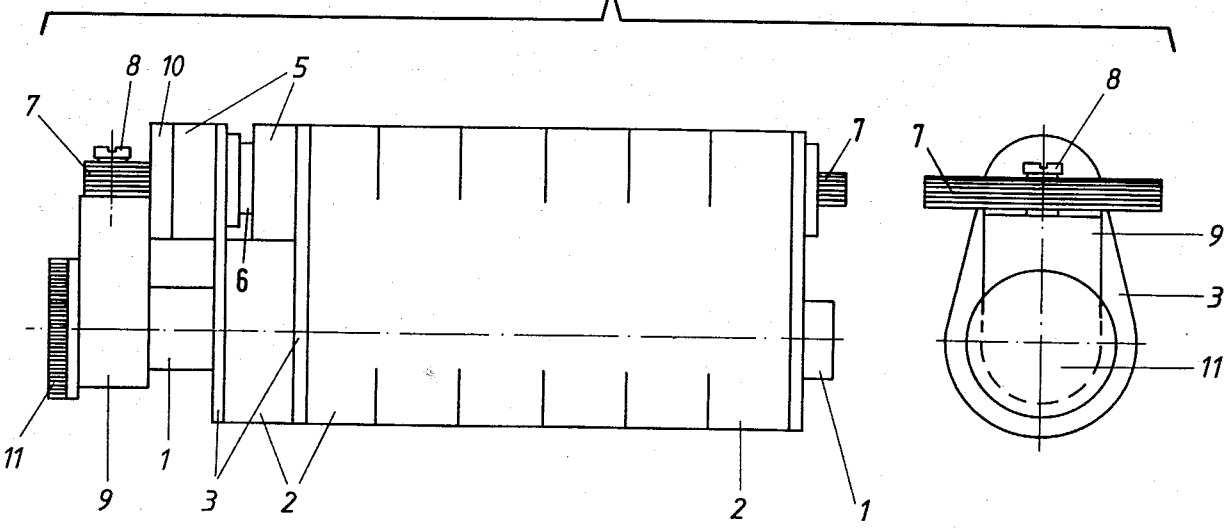
FIG. 1 is a side and rear view of a head of a matrix printer according to the invention.

Firstly, it should be pointed out that the advantages achieved with the invention result essentially from the combination of the matrix printing head shown in FIG. 1 with the driver circuits illustrated further on, i.e. the matrix printing head and the associated drive circuit form an inseparable unit.

FIG. 1 shows a sideview and a rearview of the matrix printing head.

All the drive systems 2 are fitted on a common core 1 in a number corresponding to the number of printing punches. In FIG. 1, only one drive system 2 is shown exactly and the other systems, which are identical, are only indicated symbolically.

The magnetic field produced by the coils, not shown in FIG. 1, of the drive systems 2 is conducted through pole plates 3 and supplied by the latter via pole rings 5 to tubular-shaped armatures 6.

The printing punches or elements 7 which have the form of sheet strips traverse jointly all the pole rings 5. They are arranged parallel to each other and mounted by means of a screw 8 on the holder 9 which is centered with an extension 10 in the rearmost pole ring and screwed with a knurled screw 11 to the core 1.

Figure 2:
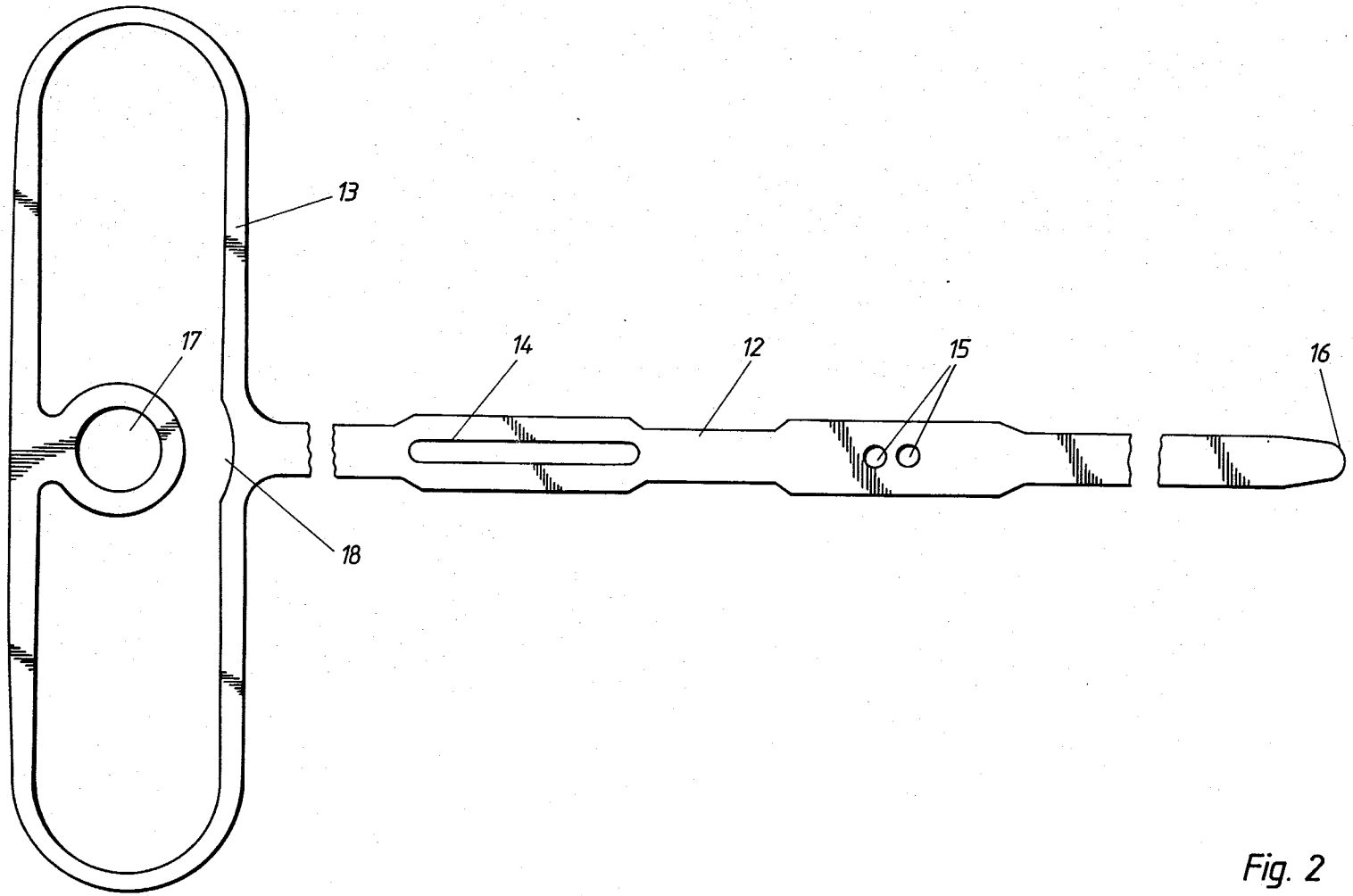
FIG. 2 is a printing punch of the head according to FIG. 1.

FIG. 2 shows more exactly the form of a printing punch 7. The shank 12, which is shown broken away at two locations in FIG. 2, and a loop-shaped reset spring 13 form the main parts of the printing punch 7. The shank 12 has a rectangular cross-section, the wide side of which can be seen in FIG. 2. The rectangular cross-section increases the resistance moment in the direction of the movement of the matrix printing head. Since on striking ink ribbon and paper the printing punches are stressed solely in this direction, the irregular resistance moment represents, for the same mass, an advantage compared with circular or square cross-sections.

At each point of passage through the drive systems 2 the shank 12 comprises slots 14, with one exception, i.e. the number of slots 14 is one less than the number of drive systems 2. At one point of passage through the drive systems 2, at different points for each of the printing elements, the shank 12 has two bores 15 which permit positive mechanical coupling to the armature.

At the end of the printing punch employed for the printing the shank comprises a rounded portion 16. Said rounded portion 16 prevents the punch from sticking after impact on the ribbon or paper and thus reduces the stress of the printing punch during the printing operation.

Of particular significance is the reset spring 13 integrated into the printing element 7, and lying in the same plane as the latter. The integration not only reduces the number of parts of a drive system but the inevitable tolerances in drive systems operating with separate springs and manifesting themselves in undefined inoperative punch positions are also reduced.

Provided at the rear stationary end of the printing punch is a bore 17 which serves for common mounting of all the printing punches by means of a common screw 8 on the holder 9. This mounting permits each individual printing element pivotal movement in the direction of rotation but fixes the printing element exactly in the longitudinal direction of movement.

A concave rounded portion 18 serves as rest for the printing punches on a damping element placed round the bore 17 and common to all printing punches but not shown in the drawings.

If via the positive connection a force is exerted at the bores 15 in the direction towards the rounded portion 16, the spring 13 bends and permits longitudinal displacement of the shank 12. The slots 14 leave clearance for the connecting portions belonging to the other printing punches 7 of the printing head. At the same time the slots 14 effect parallel guiding of the printing punches 7 because connecting portions of other punches extend through the slots and are secured in the armature holders which in turn are longitudinally guided by the associated pole rings 5.

Figure 3:
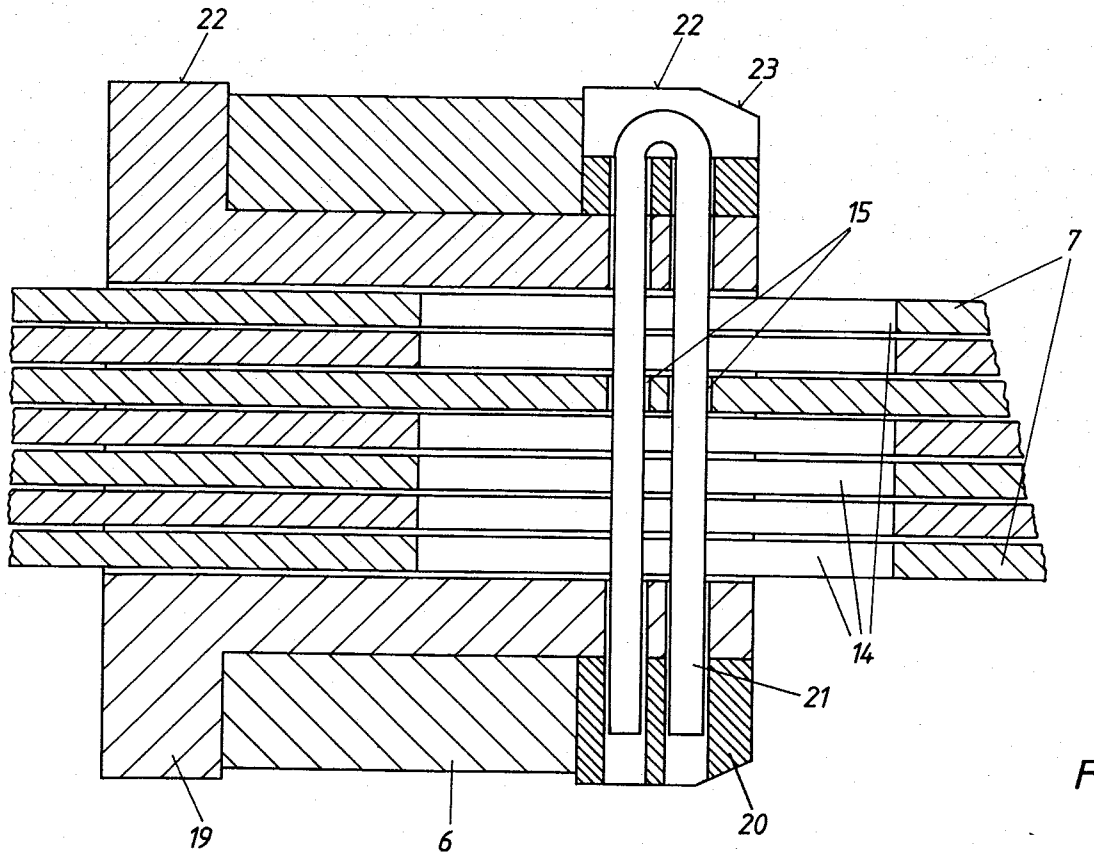
FIG. 3 is a sectional view of the armature mounting with armature and connection to the printing elements of the head according to FIG. 1.

FIG. 3 shows details of the armature holder and the passage of the printing punches 7 through the armature holders. Seven printing punches are shown although within the framework of the invention a lesser or greater number of printing punches may be provided.

The printing elements 7 have, except for one, slots 14 at a passage point whereas one printing punch 7 comprises bores 15 for the positive coupling to the armature holder.

The armature holder consists of a tubular sleeve 19 with rectangular passage for the traversing of all the printing punches 7 and of a ring 20. A clearance is preferably left between the printing punches and the sleeve 19 to permit passage of the displaced air during the movement of the armature holder. The sleeve 19, ring 20 and the printing punch associated with said armature are connected by a pin-like connecting member 21, which is formed here as two-leg wire needle, and have corresponding bores for this purpose. The sleeve 19 and ring 20 positively secure the tubular armature 6 of soft iron in position. The sleeve 19 and ring 20 are bordered outwardly by cylindrical slide faces 22 which have bevelled portions 23 or rounded portions at one or more edges.

Figure 4:
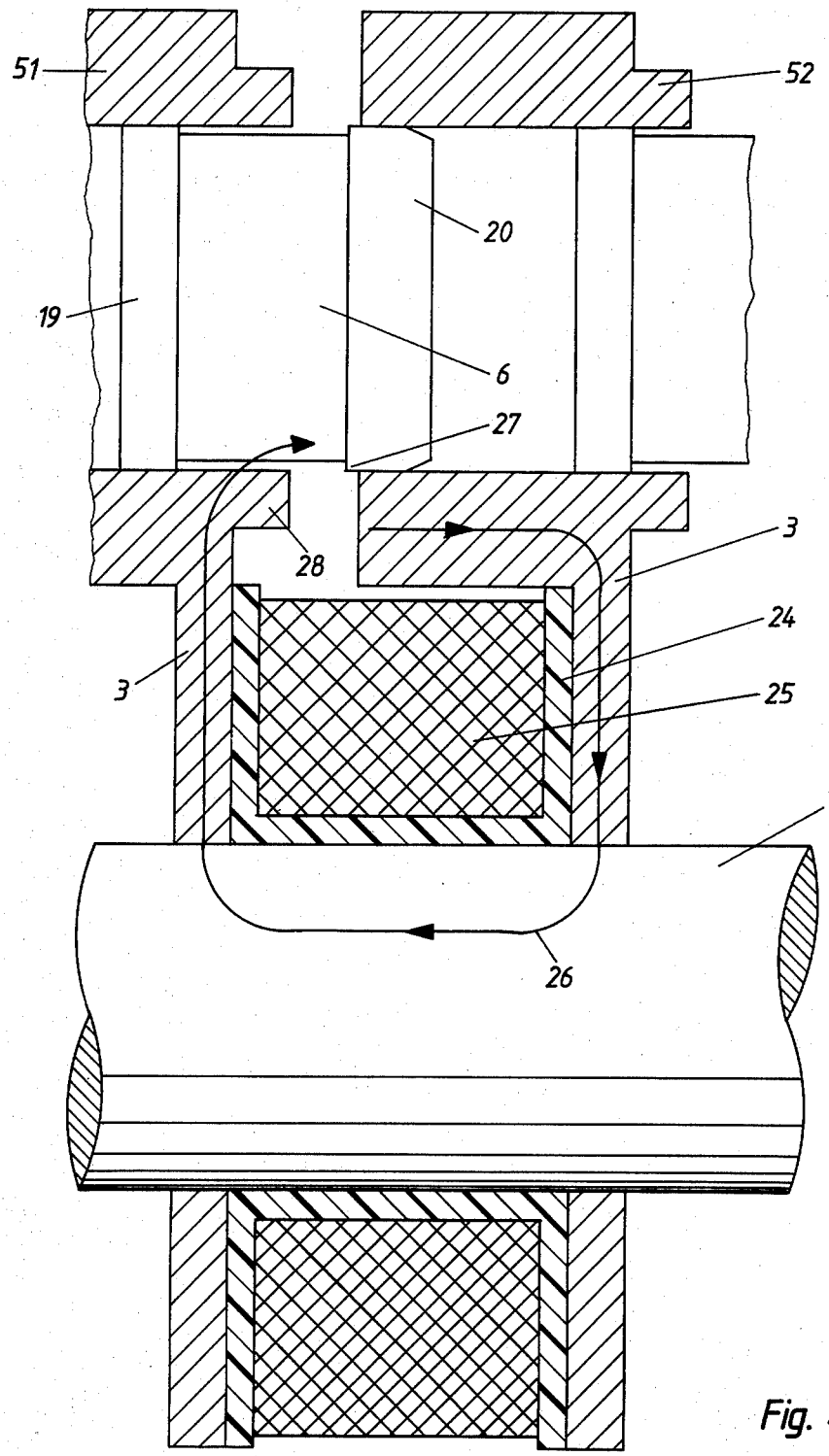
FIG. 4 is a simplified section of a portion of the head of FIG. 1.

FIG. 4 shows to a smaller scale a portion of a matrix printing head, the details of the armature guide illustrated in FIG. 3 being omitted. A coil body 24 of insulating material contains a coil 25 and is disposed on the core 1 between two pole plates 3 which open into pole rings 51 and 52. The armature holder comprising the sleeve 19 and ring 20 with the armature 6 slides in said rings. In the pole ring 52 the sleeve and armature of the adjacent drive system 2 are indicated.

If a current is passed through the coil 25 a magnetic flux is formed corresponding to an arrow 26 and generates a strong field in the narrow air-gap 27 between the armature 6 and pole ring 52. Said field drives the armature 6 into the pole ring 52.

The face of the pole ring 51 opposite the face of the pole ring 52 has an annular widened portion 28 to ensure a good flux passage from the pole ring 52 to the armature 6 and at the same time to reduce the spurious flux between the pole ring 51 and the pole ring 52.

The diameter of the armature 6 is somewhat less than the diameter of the slide surfaces 22 of the armature holder so that during the movement only said slide surfaces 22 and not the armature 6 bear on the pole rings 51 and 52.

The air-gap 27 is smaller than the desired stroke of the printing punch. The armature holder and armature 6, after the acceleration, continue their movement into the pole ring 52 because of their inertia until the printing punch 7 strikes.

The pole plates 3 and pole rings 51 and 52 each serve to guide the magnetic flux in successive drive systems 2. This considerably simplifies the construction and reduces the overall dimensions and weight.

Since the armature 6 has its maximum speed shortly after entry into the pole ring 52, the impact energy of the printing element 7 is substantially independent of the further stroke. It is thus possible to reduce the overall stroke to increase the printing speed without changing the impact of the printing element 7 on the ink ribbon and paper and thus without changing the printing operation itself.

The printing mechanism according to the invention permits an easy interchanging of the entire printing set with the associated armatures and armature holders. For this purpose, it is only necessary to release the knurled screw 11 and remove the holder 9 with the punch set and all the armature holders from the alignment of the pole rings 5. It is just as easy to reintroduce a pre-assembled punch set with holder 9.

The possibility of easy replacement is achieved by integrating the spring 13 into the printing element 7 and the free moveability of the pole rings 51 and 52 with respect to the armature holders 19 and 20.

The short acceleration path for the armature with subsequent free flight, i.e. the short air-gap 27, can only be utilized effectively if the coils 25 produce current rises as quickly as possible in the short time available. For this purpose, the current rise delayed by the inductance of the coil 25 must be made as steep as possible and thereafter the coil operated for the greater part of the time with constant current or constant magnetic induction in the magnetically narrowest iron cross-section.

This is achieved with the circuits described hereinafter. The circuit shown in FIG. 5 comprises electronic switches 30 which are associated with the coils 25 and which comprise in known manner transistors or thyristors and are driven in selectable combinations by a character generator 31 of known construction. Character generator 31 is a generator of the type used in printers, screen displace devices, etc., and is in the form of a build up element. Character generators that could be used in the present invention are, for example, those manufactured by Texas Instruments Co., Model TMS 4179NC or TMS 4100JC. The coils 25 are bridged with diodes or other protective circuits 32. The supply voltage is fed to them via the connection 33. At the output the coils 25 are connected to a controllable electronic power switch 34 which is controlled by a function generator 35. Function generators such as function generator 35 are used in laboratory instruments and are manufactured, among others, by Hewlett Packard Co., for example, Model 3312 A (called "function generator") or Model 8165 A (called "programmable signal source"). The function generator 35 is also driven by the character generator 31.

Firstly, with the aid of FIG. 6 the function of an embodiment will be described which involves particularly low expenditure and is used particularly for low printing speed.

A character generator 31 is used which drives the switches 30 successively. Such character generators are known and are used for example for driving cathode-ray tubes for displaying characters. FIG. 6 illustrates two control pulses which open different switches 30 on the line 36 of the diagram. Along the line 37 the open time of the two different switches 30 is illustrated, i.e. on the left of the one switch and on the right at the edge of the Figure of the second selected switch.

The character generator 31 further emits synchronously with each control pulse 36 a control pulse to the function generator 35. After being triggered by the character generator 31 said function generator 35 delivers a pulse sequence as illustrated on the line 38 in FIG. 6. As example of such a pulse sequence on the line 38 a rectangular voltage of constant frequency but variable duty cycle has been chosen. At the beginning the intervals between the pulses are small but become greater towards the end of the curve.

The function generator 35 switches on the circuit-breaker 34 and thus passes the current through the respective connected coil 25. The variation of this current is shown by line 39 in FIG. 6. During the first on period of the power switch 34 the current rises with a delay due to the inductance of the coil 25. During the intervals the current flows through the respective diode 32 and decreases somewhat. The programmed variation of the duty cycle of the function generator 35 gives a mean constant current which is indicated by the dashed line 40 in FIG. 6. After the last open pulse of the power switch 34 the energy contained in the coil discharges via the diode 32.

Figure 5:
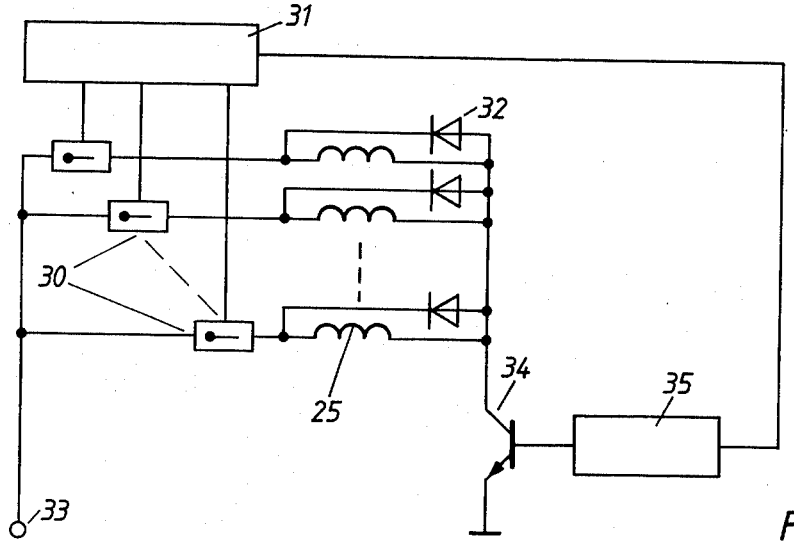
FIG. 5 is a common driver circuit for the energization current of all magnetic systems of the head according to FIG. 1.

Using programs other than the program 38 illustrated in FIG. 5 current variations different to the current variation 39 illustrated in FIG. 5 can be achieved. If the losses via magnetic leakage in the drive system are to be minimised, the program is designed so that the duty cycle decreases further towards the end of the current rise when the air-gap becomes smaller by movement of the armature and the coil current 39 again decreases with respect to the constant centre section. This ensures that the magnetic induction does not reach saturation anywhere in the magnetic circuit at any time during the armature movement.

Assuming adequate time and thermal stability of the drive systems, the program for the function generators of different matrix printing heads may be made the same and invariable. However, if thermal stability of the drive systems cannot be assumed the program is adapted via known control means automatically to the temperature of the drive systems, which is measured by known devices.

The program can also be changed manually with known means. For example, the impact energy of the printing elements may be adjusted during the printing operation.

In one modification of the circuit according to FIG. 5 the function generator 35 is an analog value generator. The power switch 34 then acts as continuously variable regulator. This choice reduces the disturbances produced by the circuit by the key but leads to greater power consumption.

A further modification of the circuit according to FIG. 5 is obtained when the character generator 31, as is often usual for controlling matrix printing heads because of the printing speed required, does not drive the switches 30 successively but simultaneously.

Figure 6:
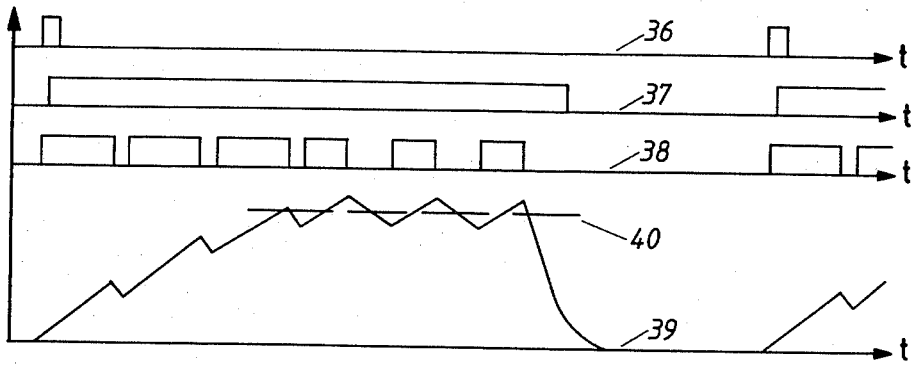
FIG. 6 shows the curve of the operations in the driver circuit according to FIG. 5.

In this case as well FIG. 6 applies but the interval between the two control pulses on the line 36 is about ten times as large, depending on the number of drive systems. In contrast to successive driving, parallel driving of the switches 30 requires a more complicated construction of the power switch 34. On the other hand, this circuit permits the individual diodes or other bridging circuits 32 to be replaced by a bridging circuit common to all the coils, possibly via the power switch 34.

Within the scope of the invention it is also possible to select between successive and parallel driving of the switches 30.

Figure 7:
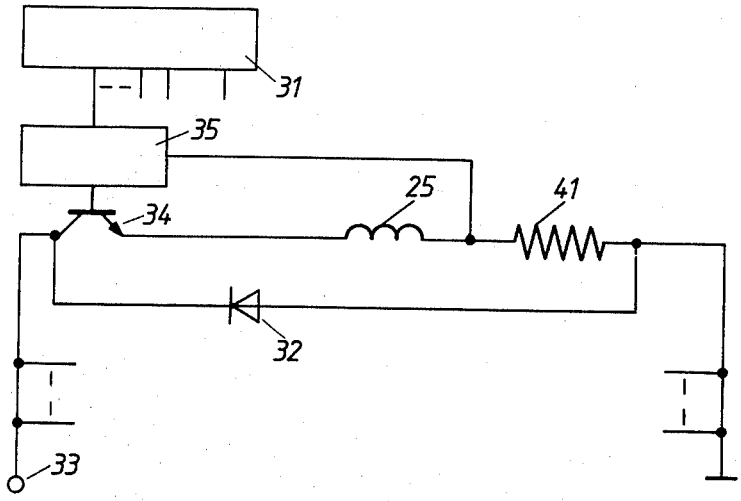
FIG. 7 is an alternative driver circuit for the energization current of a magnetic system of the head according to FIG. 1.

FIG. 7 represents a circuit employing the basic idea of the circuit of FIG. 5 for the case in which because of production tolerances of the drive systems it is not possible or practicable to prescribe the same current variation for all the coils 25. In addition, current regulation is introduced and can be applied also to the circuit of FIG. 5.

In FIGS. 7 each coil 25 has associated therewith its own power switch 34 with function generator 35. The character generator 31 starts, as described simultaneously or successively, the cycle in the function generators 35. The power switches 34 are, as described, constructed either as on-off regulators or as continuously variable regulators.

Thus, in contrast to the circuit according to FIG. 5 the current regulation is effected individually for each drive system. Manufacturing differences in the drive systems can be taken into account by differentiated programming in the function generators 35.

An individual adjustment which can be superimposed on the program control is effected by the resistance 41. The voltage taken from said resistance and supplied to the function generator 35 corresponds to the current flowing through the coil 25. It is evaluated in the function generator 35 in the manner known in the art of current regulation to give a control voltage for driving the power switch 34 or superimposed on the control voltage produced in the function generator according to the fixed program.

What we claim is:

1. In a matrix printer in which a plurality of printing punches in the form of sheet strips are arranged parallel to each other and are driveable in different combinations according to the characteristics to be printed, by means of drive systems arranged in series and being associated each with a printing punch, each drive system containing an armature mechanically coupled to the printing punch, as well as a magnetic circuit providing for an air gap and a control coil, and a reset spring being associated with each printing punch for pulling the armature away from the air gap range into an inoperative position, the improvement which comprises said reset spring being loop-shaped and formed as an integral part of an associated printing punch at the stationary end thereof, and lying in the same plane as that of the associated printing punch.

2. An improved matrix printer as set forth in claim 1, further comprising said magnetic circuit being provided with an air gap which is smaller than the stroke of the printing punch, so that after closure of the air gap, the armature flies on substantially freely due to its inertia until the printing punch strikes.

3. An improved matrix printer as set forth in claim 1, wherein the armature of each drive system is tubular shaped, and all the printing punches traverse all armatures of the drive systems, and wherein the improvement further comprises armature holders for guiding the printing punches in the drive systems, and means for guiding said armature holders, associated with said magnetic circuit, said guiding means having an inner width dimension which is greater than the outer dimensions of the armatures, printing punches, and armature holders.

4. An improved matrix printer as set forth in claim 3, wherein said guiding means comprise pole rings and said armature holders with the armatures slide in said rings, and wherein the printing punches with their associated armatures and armature holders form preassembled interchangeable sets that could easily be assembled in a matrix printer or removed therefrom.

5. An improved matrix printer as set forth in claim 1, wherein the magnetic fluxes of adjacent drive systems flow through common stator members.

6. An improved matrix printer as set forth in claim 5, wherein the coils of all the drive systems are disposed on a common core which lies parallel to the axis of the armature.

7. An improved matrix printer as set forth in claim 1, wherein current flowing through the coils of the drive systems is so controlled that it remains constant after the rise due to the inductance of the coils.

8. An improved matrix printer as set forth in claim 1, wherein current flowing through the coils of the drive systems is so controlled that the magnetic induction produced in the flux-carrying portions of the drive systems, after the rise due to the inductance of the coils, remains constant taking account of the change in the air gap caused by the armature movement.

9. An improved matrix printer as set forth in claim 7, further comprising a function generator which controls the current by a time dependent programme common to all coils.

10. An improved matrix printer as set forth in claim 1, further comprising a function generator for controlling current flowing through the coils, a power switch controlled by said function generator, and electronic switches for successively connecting the coils to said power switch, so as to obtain lower power necessary for low printing speeds.

11. An improved matrix printer as set forth in claim 2, wherein the printing end of each printing punch is provided with a rounded portion, so as to prevent the printing punches from sticking to printing paper or ribbon during a printing operation.

12. An improved matrix printer as set forth in claim 3, wherein said reset spring is connected at its stationary end to an armature holder in such a manner that said end is always fixed in the longitudinal direction of movement and pivotally movable about an axis of rotation.

13. An improved matrix printer as set forth in claim 1, further comprising means for effecting mechanical coupling of the printing punches to the armature and armature holders, said effecting means comprise the printing punches being each provided with a slot and a pair of bores, and a pin-like connecting member traverses through respective slots of unassociated printing punches and engages a pair of bores in the associated printing punch, in order to effect mechanical coupling between the associated printing punch and respective armature and armature holders.

14. An improved matrix printer as set forth in claim 1, further comprising a function generator for controlling the flow of current in the magnetic circuit, a power switch controlled by said function generator and electronic switches for simultaneously connecting the coils to said power switch, so as to obtain higher power necessary for high printing speeds.

15. An improved matrix printer as set forth in claim 1, further comprising a function generator and a power switch controlled by said function generator, said power switch being operable to control current flow in each coil.

16. An improved matrix printer as set forth in claim 1, further comprising an on/off regulator including a function generator and a power switch controlled by said function generator for regulating or controlling current flowing through the coils.

17. An improved matrix printer as set forth in claim 1, further comprising each reset spring being provided at the end thereof facing away from the printing end of the printing punch, with a bore and fastening means engaging said bore for mounting the reset spring on an armature holder, said bore in each of said reset springs serving for common mounting of all the printing punches by said fastening means on said armature holders, and said mounting permits each individual printing punch to pivotally move in the direction of rotation, while at the same time being fixed in the longitudinal moving direction.

18. An improved matrix printer as set forth in claim 1, wherein the printing punches are each provided with a slot at the point of passage through the drive systems, said slot providing clearance for connecting portions of other printing punches and at the same time effecting parallel guiding of the printing punches.

* * * * *